US011564415B2

(12) United States Patent
Daryani

(10) Patent No.: US 11,564,415 B2
(45) Date of Patent: Jan. 31, 2023

(54) SLIDE-ON ATTACHMENT FOR ELECTRONIC SMOKING DEVICES

(71) Applicant: Fontem Holdings 1 B.V., Amsterdam (NL)

(72) Inventor: Neha Daryani, Hamburg (DE)

(73) Assignee: Fontem Ventures B.V., Amsterdam (NL)

( * ) Notice: Subject to any disclaimer, the term of this patent is extended or adjusted under 35 U.S.C. 154(b) by 1291 days.

(21) Appl. No.: 15/766,790

(22) PCT Filed: Oct. 17, 2016

(86) PCT No.: PCT/EP2016/074877
§ 371 (c)(1),
(2) Date: Apr. 6, 2018

(87) PCT Pub. No.: WO2017/064324
PCT Pub. Date: Apr. 20, 2017

(65) Prior Publication Data

US 2018/0289059 A1 Oct. 11, 2018

(30) Foreign Application Priority Data

Oct. 16, 2015 (EP) ..... 15190222

(51) Int. Cl.
*A24F 47/00* (2020.01)
*A24F 40/30* (2020.01)
(Continued)

(52) U.S. Cl.
CPC ..... *A24F 40/30* (2020.01); *A24F 40/42* (2020.01); *A24F 40/10* (2020.01)

(58) Field of Classification Search
CPC ..... A24F 47/008; A24F 40/30; A24F 40/42; A24F 40/10; A24F 47/00; A24F 9/00;
(Continued)

(56) References Cited

U.S. PATENT DOCUMENTS 5,724,997 A * 3/1998 Smith et al. ..... A24D 3/061 131/331
2013/0074857 A1* 3/2013 Buchberger ..... A24F 42/60 131/329

(Continued)

FOREIGN PATENT DOCUMENTS

CN 204146334 U 2/2015
CN 204377939 U 6/2015

(Continued)

OTHER PUBLICATIONS

Marc Behl et al, "Shape Memory Polymers", Materials Today, vol. 10, No. 4, 2007, https://reader.elsevier.com/reader/sd/pii/S1369702107700470?token=6717CB4D8141F2E8E4E4F4B6839BE5FC65FAE13AA19F95893A4EA4E1257FBF5955A61AAB58EC5364C707DD368DDE4EED (Year: 2007).*

(Continued)

*Primary Examiner* — Michael H. Wilson
*Assistant Examiner* — Dionne W. Mayes
(74) *Attorney, Agent, or Firm* — Dykema Gossett PLLC

(57) ABSTRACT

The invention relates to a slide-on attachment (500) for use with an electronic smoking device (10), the slide-on attachment (500) comprising a body (100) and a plurality of end-caps (300) fitted on the body (100), the body (100) comprising a plurality of cavities, the plurality of cavities (106, 108) comprising a central cavity (106) capable of facilitating fitting the slide-on attachment (500) on the electronic smoking device (10), and at least one lateral cavity (108) comprising a material imbibed with flavored fluid.

15 Claims, 9 Drawing Sheets

(51) Int. Cl.
*A24F 40/42* (2020.01)
*A24F 40/10* (2020.01)

(58) Field of Classification Search
CPC .. A24F 13/00; A24F 13/02; A24F 3/04; A24F 13/22; A24F 40/00
See application file for complete search history.

(56) References Cited

U.S. PATENT DOCUMENTS

| | | | | |
|---|---|---|---|---|
| 2014/0123991 | A1* | 5/2014 | Fujita et al. | B01J 20/28004 131/335 |
| 2014/0196731 | A1* | 7/2014 | Scatterday | A24F 15/01 131/329 |
| 2015/0008149 | A1* | 1/2015 | Liu | A24F 15/20 206/257 |
| 2015/0020824 | A1* | 1/2015 | Bowen et al. | A61P 25/26 131/328 |

FOREIGN PATENT DOCUMENTS

| | | | | |
|---|---|---|---|---|
| CN | 204483019 | U | | 7/2015 |
| CN | 204560971 | U | * | 8/2015 |
| WO | 98/17130 | A1 | | 4/1998 |
| WO | 2014/139609 | A2 | | 9/2014 |

OTHER PUBLICATIONS

Mechanical English Translation of CN 204560971 U, http://translationportal.epo.org/emtp/translate/?ACTION=description-retrieval&COUNTRY=CN&ENGINE=google&FORMAT=docdb&KIND=U&LOCALE=en_EP&NUMBER=204560971&OPS=ops.epo.org/3.2&SRCLANG=zh&TRGLANG=en, printed from the Internet on Nov. 1, 2021. (Year: 2021).*

* cited by examiner

SLIDE-ON ATTACHMENT FOR ELECTRONIC SMOKING DEVICES

FIELD OF INVENTION

The present invention relates generally to attachments for electronic cigarettes, and in particular, to attachments for electronic cigarettes that facilitate the cold delivery of flavor to a user of the electronic cigarette.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

The vaporized or atomized liquid provides the users of electronic cigarettes, in addition to nicotine either with flavorless vapor or with a vapor that has a single flavor, while the cartomizer is still filled. As such the users that wish to change the flavor they experience mid-cartomizer are not accommodated by the electronic cigarettes currently available on the market. If the users wish to customize the flavor of the vapor they inhale, they need to sacrifice the cartomizer by exchanging it early, even if the cartomizer is still full.

If the users opt for using with their electronic cigarettes a cartomizer comprising flavored liquid, they will note that deposits of gunk on the heating coil of the electronic cigarette are accelerated, compared with the cases when they use unflavored liquid, as deposition of the volatile flavors comprised by the atomized liquid occurs on the heating coil. As such the lifespan of the heating coil of the electronic cigarettes might be compromised earlier when using flavored liquids as opposed to the case where the atomized liquid is flavorless.

Therefore, a need exists in the field of electronic cigarettes for cigarettes that allow flavor customization while at the same time exhibit long coil life.

SUMMARY OF THE INVENTION

In accordance with one aspect of the present invention there is provided a slide-on attachment for use with an electronic smoking device. The slide-on attachment comprises a body having a plurality of cavities, and the plurality of cavities comprise a central cavity capable of facilitating fitting the slide-on attachment on the electronic smoking device in a detachable manner, and at least one lateral cavity acting as a liquid reservoir and comprising a material imbibed with volatile flavored fluid.

In accordance with another aspect of the present invention there is provided a system comprising the slide-on attachment described above and an electronic smoking device. The electronic smoking device comprises a housing accommodating a atomizer/liquid reservoir portion having an atomizer adapted to atomize a liquid supplied from a liquid reservoir, and a battery portion comprising an electric power source.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
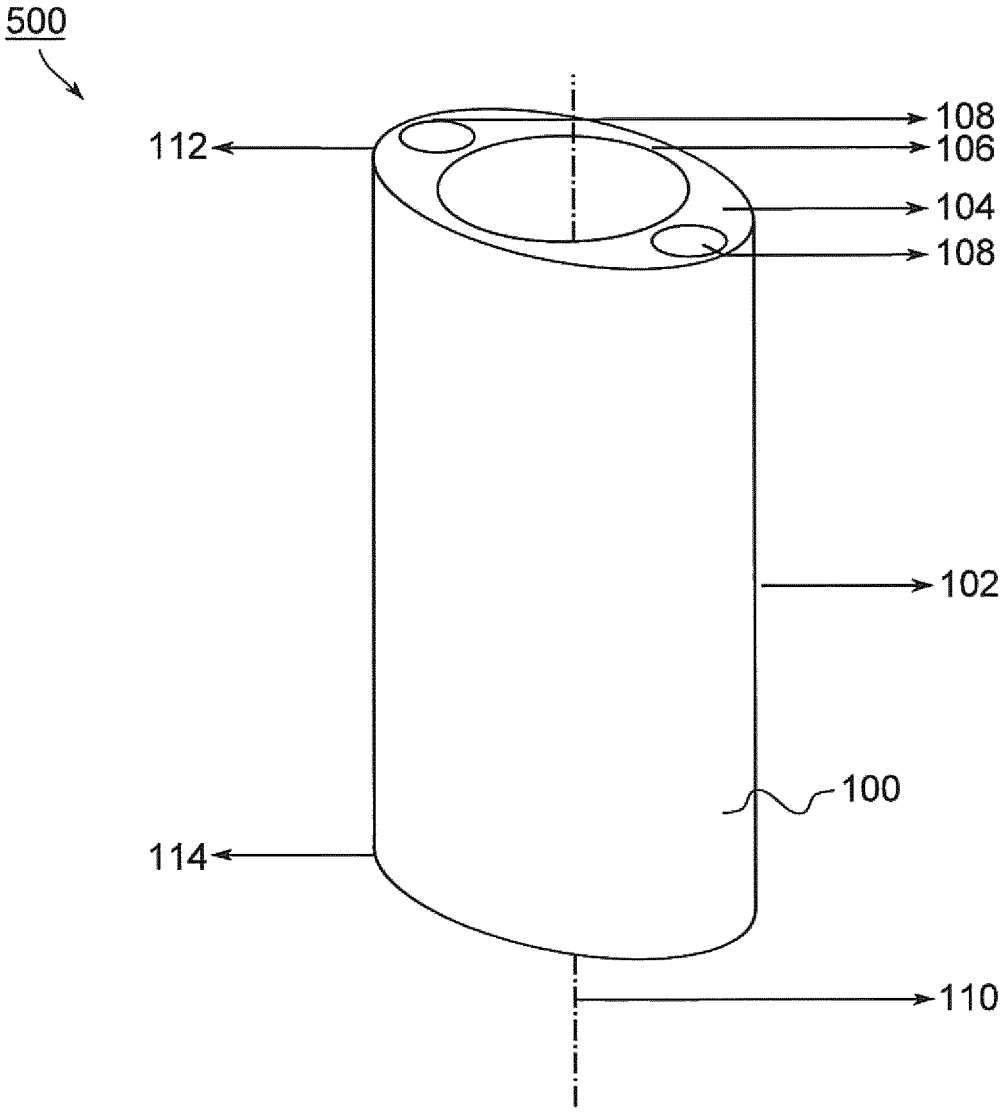
FIG. 1 is a perspective view of a body of a slide-on attachment for an electronic cigarette.

The apparatus shown in the drawings has parts that are examples of the elements recited in the claims. The illustrated apparatus thus includes examples of how a person of ordinary skill in the art can make and use the claimed invention. These examples are described here to provide enablement and best mode without imposing limitations that are not recited in the claims.

FIG. 1 is a perspective view of a body of a slide-on attachment for an electronic cigarette in accordance with one embodiment of the present invention.

FIG. 1 shows a cylinder 100 that may constitute the body of a slide-on attachment for an electronic cigarette. Cylinder 100 comprises, on its external surface, a cylinder liner 102 and an inner portion of the cylinder 104 that is encapsulated by the cylinder liner 102. The cylinder 100 is shown in FIG. 1 as having a central cavity 106, extending along the entire length of the cylinder 100 and a pair of lateral cavities 108 that extend as well along the entire length of the cylinder 100 parallel to a central axis 110 of the cylinder 100. The central cavity 106 and the lateral cavities 108 may be all lined on their interior surface with the same cylinder liner material 102 or may not be at all lined. Instead the cavities may be directly carved out in the material from which the inner portion of the cylinder 104 is made.

In the embodiment of the invention illustrated in FIG. 1 the body of the slide-on attachment has an oval cross section. The present invention is not limited to bodies with oval cross section, and their cross section might be any other shape, such as circular, triangular, quadratic, hexagonal, for as long as the body accommodates a central circular central cavity 106 and at least two lateral circular cavities 108. Therefore, the use in this document of the term "cylinder" or "cylindrical body" 100 is not intended to limit the present invention to a particular geometry of the body of the slide-on attachment.

Although not illustrated in FIG. 1, the cylinder 100 may have multiple interconnected parts, including the cylinder liner 102 and cylinder ends namely an upper end 112 and a lower end 114.

The cylinder 100 has a generally cylindrical shape centered on an axis 110, with upper and lower end surfaces 112, 114 that accommodate, as it will be described further in this document, the attachment of an upper cap and a lower cap, mountable on the upper end surface 112 and the lower end surface 114.

In one embodiment of the present invention, the cylinder 100 has the cylinder liner 102 constituting a first functional layer extending along an outer surface of the cylinder 100 and an oppositely facing first inner surface constituting the inner surface of the central cavity 106. Further, additional oppositely facing second and third inner surfaces are part of the cylinder 100, constituting the inner surfaces of the lateral cavities 108 of the cylinder. The cylinder liner 102 may be of the same or of different material than the inner portion 104 of the cylinder 100.

In another embodiment of the present invention, the cylinder 100 does not have an outer liner 102. Its outer surface is machined from the same material the inner portion 104 of the cylinder 100 is made of, especially if the material comprised by the inner portion of the cylinder is a resilient material.

The first functional layer 102 extends between a first edge of the upper end surface 112 and second edge of the lower end surface 114.

The central cavity 106 and the lateral cavities 108 are chamber openings having preferably a cylindrical shape, and as such a diameter of their openings is constant along the entire length of the cavities. The invention also contemplates non-cylindrical shapes for the lateral cavities 108, for as long as these shapes allow the slide-on attachment, when attached to the electronic cigarette, to be attached via press-fit to a body or to a mouthpiece of the electronic cigarette. Further, the invention also contemplates that the lateral cavities 108 have a non-constant diameter along their length, or that the cavities do not extend along the entire length of the cylinder 100.

The lateral cavities 106 and 108 are spaced apart from one another and separated by the material 104 of which the body of the slide-on attachment is made. The separate cavities are evenly distributed around a rotational axis 110 of the slide-on attachment. Also, when the slide-on attachment 500 is mounted on an electronic cigarette 10 the outlet of the lateral cavities 106 is separated from the inhalation port of the electronic cigarette 10, or the central cavity 104 that facilitates the installation of the slide-on attachment on the electronic cigarette, by material 104.

While the embodiment of the invention illustrated in FIG. 1 contemplates that the body 100 comprises three cavities, one central and two lateral, other embodiments are as well envisioned for the present invention, that have only one lateral cavity or more than two lateral cavities.

A material comprised by the inner portion 104 of cylinder 100 is a material with sufficient resilience to provide for stable elongated cavities through the material and may be made of macromolecular polymer foam or foamed ceramics. This material may be as well porous.

The central cavity 106 of the cylinder 100 facilitates mounting the slide-on attachment onto the electronic cigarette.

The lateral cavities 108 act like flavor reservoirs situated on each side of the mouthpiece of the electronic cigarette, once the attachment is assembled on the electronic cigarette. The side cavities 108 comprise a material that is imbibed with a fluid that comprises compounds with a volatility higher than water. The fluid may be a flavored material and/or nicotine. The flavor in each cavity may be the same or may be different.

The fluid may be an aerosol-forming liquid that is contained within the elongated lateral cavities 108, the cavities containing a sponge-like material, such as cotton or a porous material for soaking up and holding the liquid with volatile compounds.

Exemplarily, the liquid imbibed in the material contained by the lateral cavities 108 contains water in a range of from 2% to 7%, glycerol in a range of from 15% to 25% and propylene glycol in a range of from 70% to 80%. The percentages are by weight, related to the total weight of the liquid. Other ingredients, like flavorants, may be contained as well. The viscosity of the liquid is in the range of from, e.g., 55 $mm^2/s$ to 75 $mm^2/s$. This liquid is hydrophilic and has a rather high viscosity. However, the present invention is not limited thereto, and it is alternatively possible that a pure volatile flavored material or a flavored material in a comparatively higher concentration can be stored inside the elongated lateral cavities 108 having a different viscosity.

In another embodiment of the invention, the liquid imbibed in the material contained by the lateral cavities 108 contains compounds with volatility higher than water, with additives comprising a flavored material and/or nicotine.

The additive may comprise compounds with volatility higher than water. The compounds may have an evaporation number of less than 10, less than 8, less than 5 or less than 2.5, for example an evaporation number of 8.3. The compounds may have an evaporation rate of more than 3, more than 5, or more than 8, for example an evaporation rate of 3.8. Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water—for example, at least one and in particular of the flavor and/or the aroma compound of the compounds of the additive may have evaporation numbers between 3.8 and 10. In general, aroma compounds are highly volatile and this is the reason why they may be smelled at room temperature. In case the flavor and/or of the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes. The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

The flavored materials are for example esters, such as isoamyl acetate, linalyl acetate, isoamyl propionate, linalyl butyrate and the like or natural essential oils as plant essential oils, such as spearmint, peppermint, *cassia*, jasmine and the like or animal essential oils, such as musk, amber, civet, castor and the like or simple flavoring materials, such as anethole, limonene, linalool, eugenol and the like or hydrophilic flavor components such as a leaf tobacco extract or natural plant flavoring materials such as licorice, St. John's worth, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine the various flavored materials mentioned above into new flavored materials. Moreover, it is possible to adsorb any flavor onto a solid material and to use this material as flavored material within the lateral cavities.

The above discussion assumed that each of the two lateral cavities 108 are filed with the sponge-like material, each sponge like material being imbibed with the same fluid. Of course, the present invention contemplates as well cases where the favored materials are not the same for each cavity, allowing therefore the user to further customize the smoking experience. As such, different flavors can be provided to the user while using the electronic smoking device without previously mixing the flavors.

The lateral cavities 108 define the flow path for the flavor material, wherein the flow path extends to the end that is closest to the air inhalation port of the e-cigarette. The lateral cavities act like liquid reservoirs for the flavor material. An advantage of such a liquid reservoir is that the material released from the cavity while the electronic smoking device is in use does not contact the atomizer, and its properties are thus not changed by the heat issued by the atomizer, since the flavored material is not subjected to heat. The presence of the flavor material in the cavities 108 of the slide-on attachment facilitates the cold delivery of flavor to the user.

To summarize, the body 100 comprises a plurality of cavities 106 and 108, the plurality of cavities 106 and 108 comprising a central cavity 106 capable of facilitating fitting of the slide-on attachment on an electronic smoking device, and a plurality of lateral cavities 108, each lateral cavity 108 comprising a material imbibed with flavored fluid. A cross-section shape of the body is selected from the circular, oval, substantially semicircular, and polygonal shapes. The body 100 comprises a shape-memory polymer. The cavities 106 and 108 extend longitudinally for the entire length of the body 100, substantially parallel with the central axis 110 of the body 100. In another embodiment of the invention, the lateral cavities 108 extend generally in a longitudinal direction over only a part of the length of the body 100. The lateral cavities 108 are provided in a symmetric arrangement versus the central axis 110 of the body 100 and in a symmetric arrangement versus each other. A cross-sectional shape of the lateral cavities 108, along at least part of their length is a cross-sectional shape selected from the following group circular, oval and substantially semi-circular. The material imbibed with flavored fluid is one of a sponge material, wadding or cotton, and the fluid is a hydrophilic liquid. The liquid comprises at least one of water, polyoles, glycerol, propylene glycol.

Figure 2:
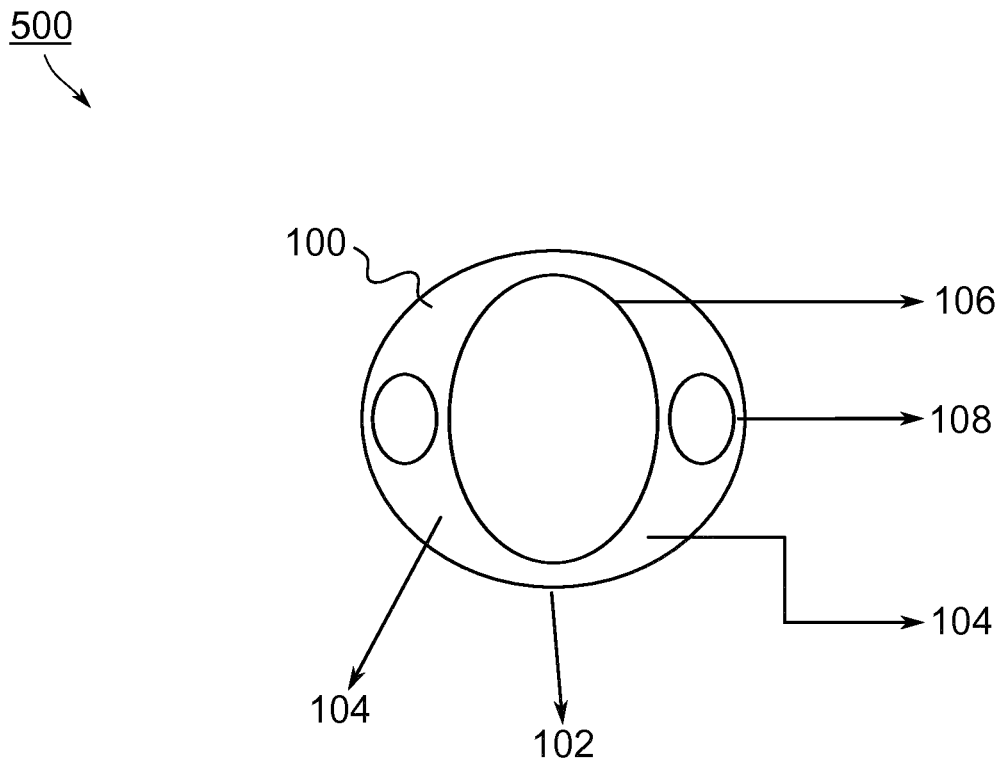
FIG. 2 is a top view of a body of a slide-on attachment for an electronic cigarette.

FIG. 2 is a top view of a body of a slide-on attachment for an electronic cigarette in accordance with one embodiment of the present invention.

As it is evidenced in the figure, the cylinder 100 constituting the body of a slide-on attachment in accordance with one embodiment of the invention comprises a circular central cavity 106 extending along the entire length of the cylinder 100 and comprising no obstructions. Further, two lateral cavities 108, in accordance with the illustrated embodiment, having as well circular cross-sections are as well included in the cylinder 100. The lateral cavities 108 are placed symmetrically versus the central cavity 106 in lateral positions versus the central cavity.

As mentioned above in the present document, illustrated in FIG. 2 is only one possible embodiment of the present invention, comprising two lateral cavities. The present invention also contemplates configurations with only one lateral cavity and with more than two lateral cavities. Further, the present invention contemplates as well lateral cavities with cross sections that are not circular.

The interstitial space between the central cavity 106 and the lateral cavities 108 constitutes the inner portion of the cylinder 104. The material 104 is a material with sufficient resilience to allow the formation there-within of stable cavities. An outer liner 102 may enclose as well the same material as the inner portion of the cylinder 104 and the cavities 106 and 108.

The slide-on attachment of the present invention comprises as well end-caps disposed at each extremity of the cylinder 100. The end-cap that is disposed at the extremity of the slide-on attachment that is the furthest from the air inhalation port of a mouthpiece of an electronic cigarette is designed to facilitate the air inlet into the slide-on attachment via openings in the end-cap. This end-cap is referred to in the following as the lower end-cap. The end-cap that is disposed at the extremity of the slide-on attachment that is the aligned with the air inhalation port of a mouthpiece of an electronic cigarette is designed to facilitate the outlet of the volatile compounds from the liquid stored in the lateral cavities 108 to the mouth of the user via openings in the end-cap. This end-cap is referred to in the following as the upper end-cap. More details regarding the relative arrangement of the end-caps versus the elements of the electronic cigarette will be provided in this document while discussing the illustration of FIG. 7.

Figure 3:
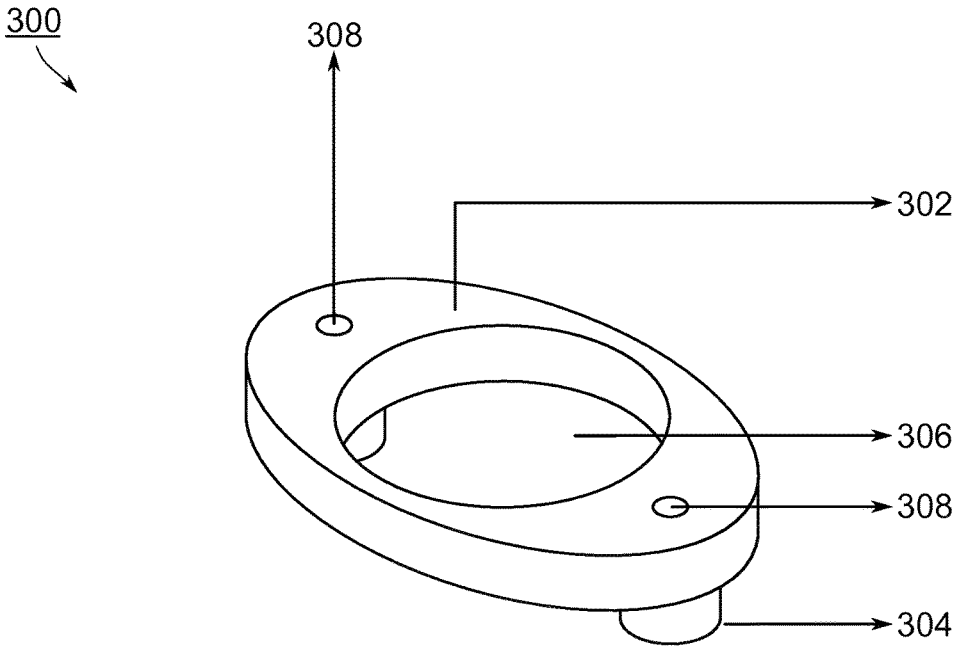
FIG. 3 is a perspective side view of an end-cap of a slide-on attachment for an electronic cigarette, taken from the top of the end-cap.

FIG. 3 is a perspective side view of an end-cap of a slide-on attachment for an electronic cigarette, perspective side view taken from the top of the end-cap.

As it may be observed in FIG. 3, end-cap 300 comprises a body 302 and a pair of legs 304. For the embodiments of the invention where the number of lateral cavities 108 of the cylindrical body 100 is larger than two, the number of legs might be equal with the number of lateral cavities. Body 302 and legs 304 may be made of the same material or may be made of different materials. In any case, the material comprised by the end-caps is distinct from the material comprised by inner portion 104 of the cylinder 100, the material of the end-caps being more resilient than the material comprised by the inner portion 104 of the cylinder 100. In one embodiment of the invention the end caps 300 are made of a plastic material, or by a material with a certain degree of plasticity.

In the embodiment of the invention represented in FIG. 3 the body 302 of the end-cap is oval. The shape of the body of the end-cap may be different than oval, such as circular, the only limitation regarding its shape being that the edges of the body of the end-cap should align perfectly with the outer liner 102 of cylindrical body 100 or in case body 100 does not comprise an outer liner, with margins of the end surfaces of body 100. Therefore for embodiments of the invention where the body 100 has a cross section that is not oval, the shape of the body 302 emulates the shape of cross section of body 100.

Body 302 has a central circular opening 306 disposed at a central position of the body 302. The diameter of the circular opening 306 is the same with the diameter of opening 106. The center of the circular opening 306 is disposed along the central axis 110 of the cylinder 100.

Body 302 has as well at least two other openings 308 disposed laterally to the circular opening 306. In embodiments of the present invention where the cylindrical body 100 has more than two lateral cavities, the number of openings 308 in body 302 may be higher than two.

As illustrated in FIG. 3 the end-cap 300 has as well a plurality of legs 304 disposed on one side of the body 302. The legs 304 have a circular shape. The position of the legs on the body 302 is aligned with the position of the openings 308, so that the openings 308 entirely traverse the length of the legs 304 and the opening 308 has a diameter that is smaller than a diameter of the legs 304. The diameter of legs 304 is comparable with the diameter of the lateral cavities 108, facilitating therefore the tight insertion of the legs 304 into the openings of lateral cavities 108 when the end-caps are installed on the body 100. This way the end-caps are detachably locked onto the body 100. The diameter of openings 308 may be adjusted and its size will strongly impact the user experience. The size of the openings 304 will be elected depending upon how volatile is the flavor imbibed in the material inserted in lateral openings 108 and what is the desired intensity of the flavor. The present invention also contemplates that the plurality of legs 304 are not circular, especially for the cases that the cross-section of lateral openings 108 is not circular.

The upper end-cap and the lower end-cap are mechanically fixed or clinched to the end of the cylinder. Their mechanical attachment is facilitated by the pair of legs 304 that are inserted in the lateral cavities 108 of the slide-on attachment.

The upper cap and the lower cap are ring-shaped or shaped with a cross section that is identical with the cross section of the cylinder, wherein the caps may include one or more fasteners adapted to mechanically fix the caps to the cylinder (not shown in the drawing). The fasteners are a pair of legs with orifices as described above or may be other fastening elements. The caps have a plurality of orifices, a central orifice that has the same shape with the shape of the central cavity of the cylinder and lateral orifices passing through the legs. The size of the central orifice may coincide with the size of the central cavity of the cylinder but it may be smaller. It has to coincide at most with the size of the opening in the mouthpiece so as not to obstruct the vapor the user inhales directly from the atomizer in the electronic cigarette.

To summarize, the end-caps 300 fitted on the body 100 comprise an upper end-cap and a lower end-cap disposed at the extremities of body 100, the end-caps comprising a plurality of legs 304 with orifices 308 and a central circular opening 306. The central circular opening 306 of said end-caps 300 overlaps an opening of the central cavity 106 when the end-caps are fitted onto the body, and a diameter of the central circular opening 306 is equal with a diameter of the central cavity 106. The legs 304 with orifices 308 are fitted in the openings of the lateral cavities 108 to facilitate fitting the end-caps 300 on the body 100.

Figure 4:
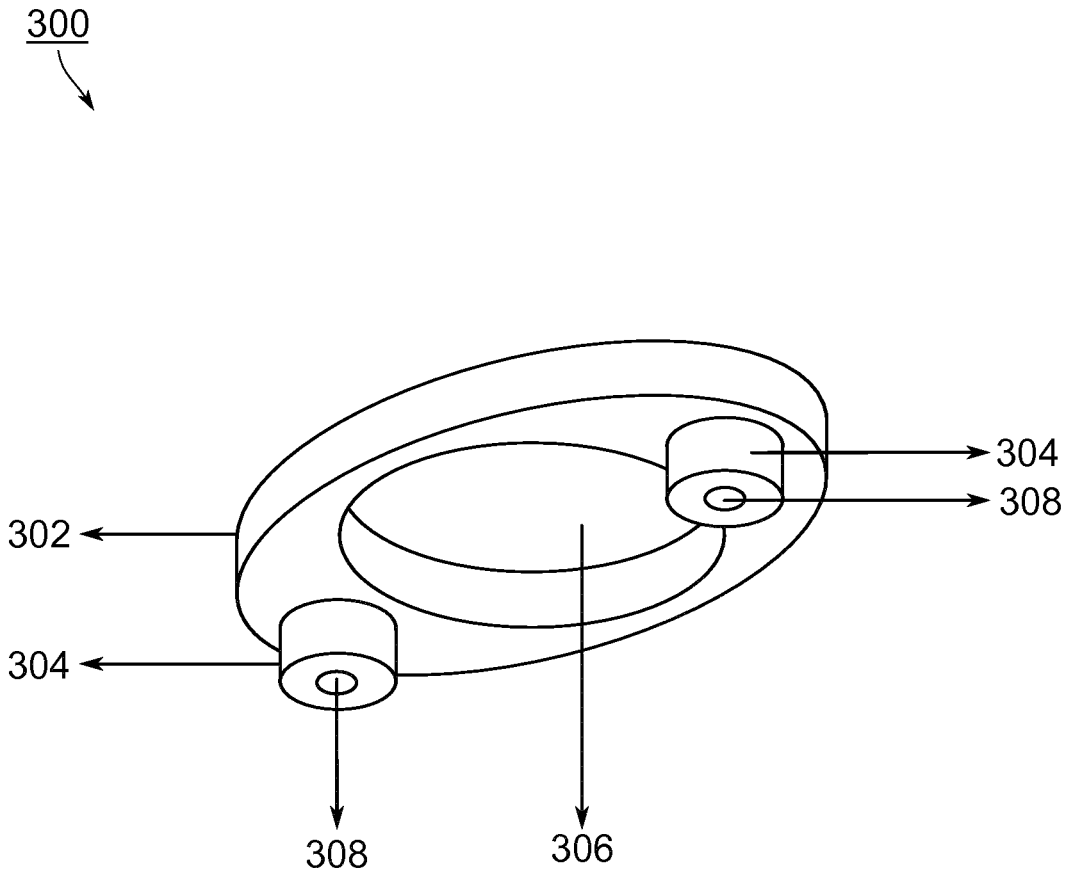
FIG. 4 is also a perspective side view of an end-cap of a slide-on attachment for an electronic cigarette, taken from the bottom part of the end-cap.

FIG. 4 is also a perspective side view of an end-cap of a slide-on attachment for an electronic cigarette, taken from the bottom part of the end-cap.

As revealed as well by the perspective side view of the end-cap taken from the bottom part of the end-cap, end-cap 300 comprises a body 302 and a pair of legs 304. A central opening 306 in the body 302 is as well illustrated in FIG. 4. A pair of legs 304 are as well disposed on the body 302, that have openings/orifices 308. All these elements were described in detail above in connection with FIG. 3.

Figure 5:
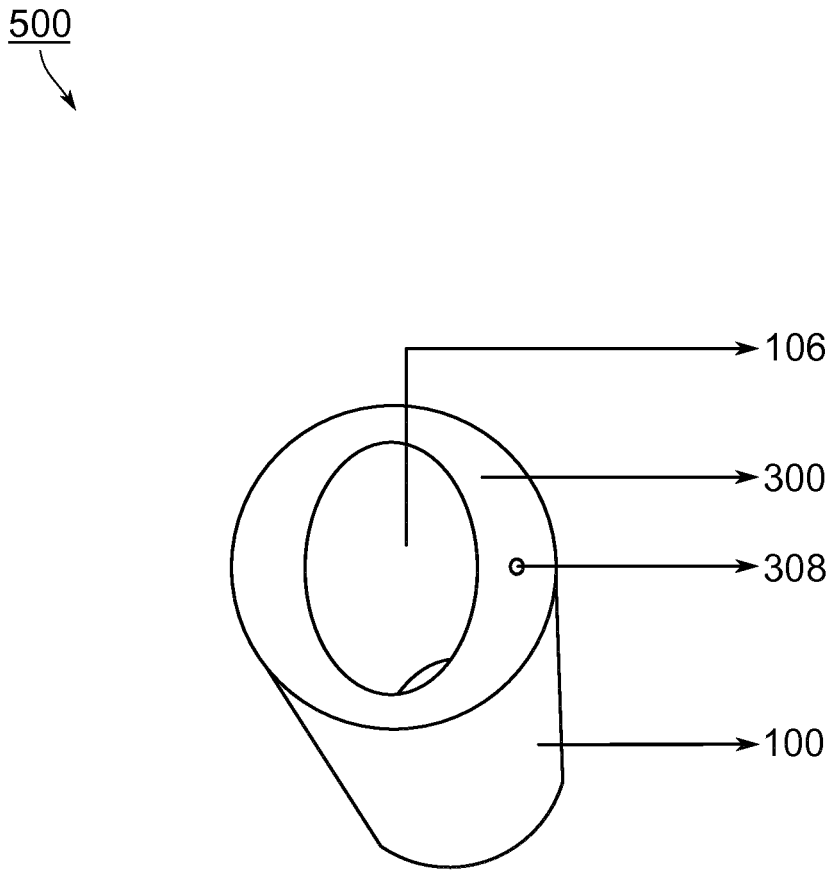
FIG. 5 is a top view of a slide-on attachment for an electronic cigarette in accordance with one embodiment of the present invention.

FIG. 5 is a top view of a slide-on attachment for an electronic cigarette in accordance with one embodiment of the present invention.

Cylindrical body 100 has been fitted with the end-caps 300 at each of its ends to form the slide-on attachment 500 for an electronic cigarette. The slide-on attachment 500 is a separate replaceable article versus the electronic cigarette that it will be used with.

As it may be observed from FIG. 5, an end-cap 300 is mounted at one extremity of the cylindrical body 100 and the resulting slide-on arrangement 500 illustrated in FIG. 5 shows that the central opening 106 of the cylindrical body coincides with the central opening 306 of the end cap. Although not illustrated in the Figure the end-cap 300 is fitted to the body 100 by fitting the legs 304 in the openings of the lateral cavities 108. The result is a slide-on attachment that exhibits two lateral openings 308 disposed symmetrically on the sides of a central opening 106. The edges of the end-cap 300 align with edges of the body 100 or in case the body comprises an outer layer, with the outer layer 102.

Figure 6:
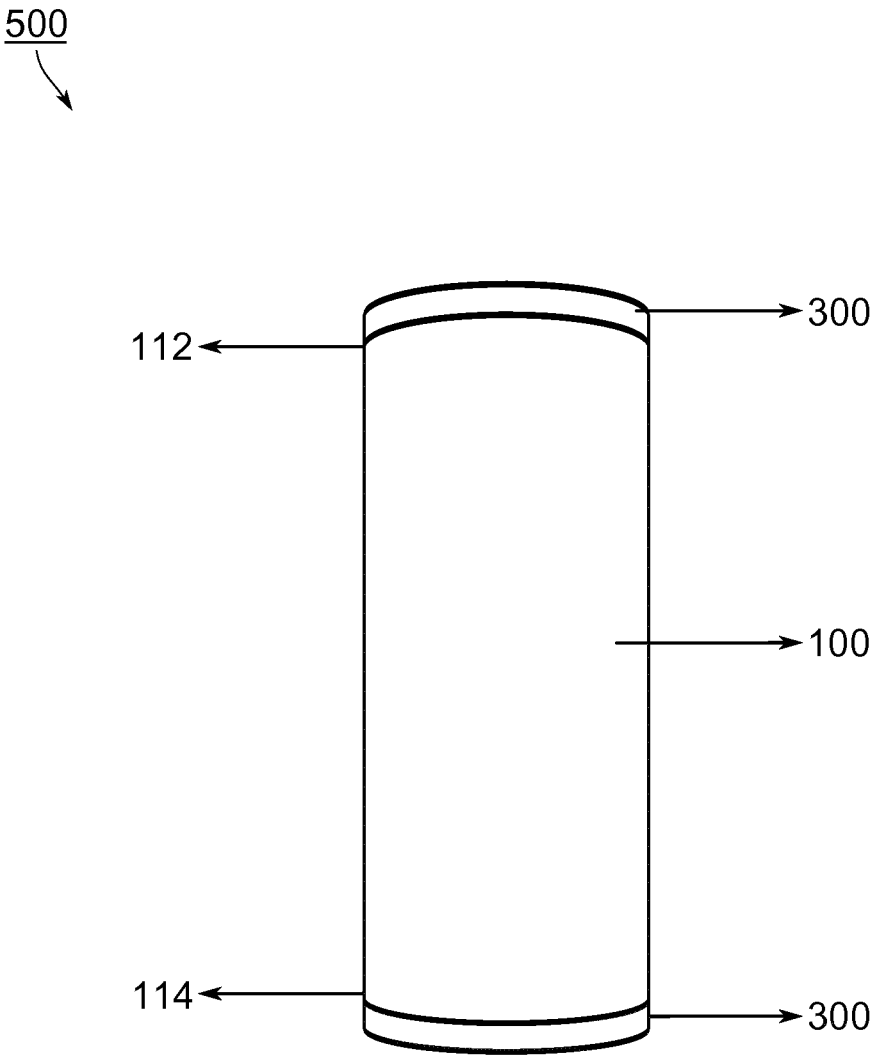
FIG. 6 is a side view of a slide-on attachment for an electronic cigarette in accordance with one embodiment of the present invention.

FIG. 6 is a side view of a slide-on attachment for an electronic cigarette in accordance with one embodiment of the present invention.

As discussed in detail in connection with FIG. 5 above, the slide-on attachment 500 illustrated in FIG. 6 comprises end-caps 300 fitted to the body 100 by inserting the pairs of legs 304 into the lateral cavities 108.

The upper 112 and lower 114 end surfaces of cylinder 100 accommodate the attachment of the caps (an upper cap and a lower cap respectively), mountable on the upper 112 and lower 114 end surfaces of the cylinder 100. The assembly of at least the body 100 comprising a central cavity and lateral cavities, comprising material imbibed with volatile flavors, with the end-caps 300 constitutes the slide-on attachment 500 for an electronic cigarette.

Figure 7:
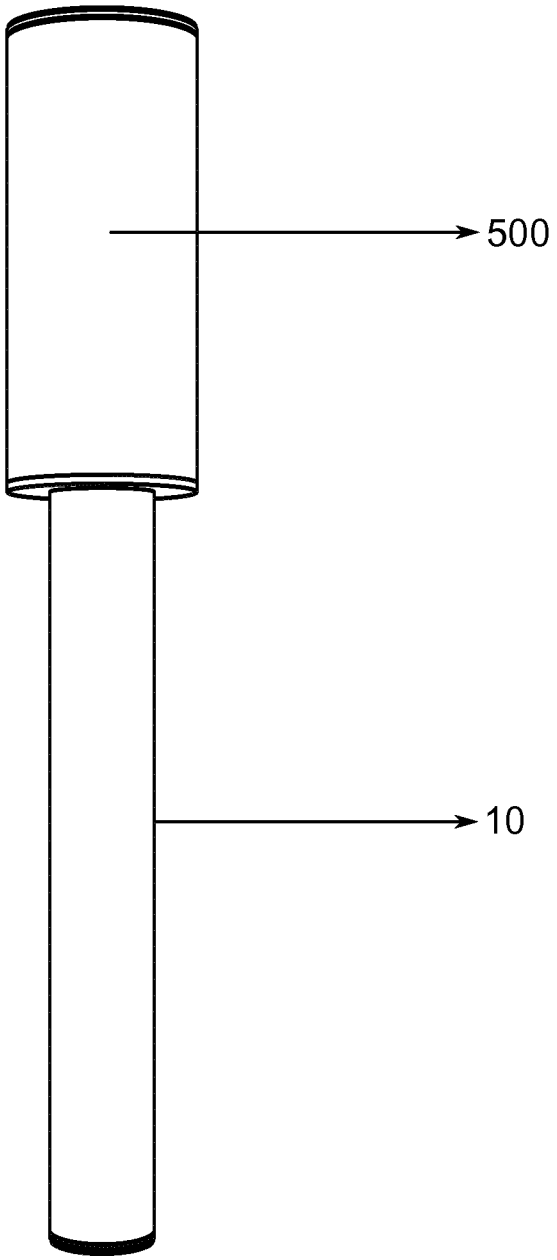
FIG. 7 is a perspective view of an electronic cigarette with a slide-on attachment.

FIG. 7 is a perspective view of an electronic cigarette with a slide-on attachment.

The slide-on attachment 500 extends circumferentially around the mouthpiece (not shown in the drawing) of the electronic cigarette 10, and is disposed on the mouthpiece in such a way that the air inlets disposed on the body of the electronic cigarette remain unobstructed. Specifically, a length of the slide-on attachment is smaller than the length of the electronic smoking device such that the air inlets disposed on the body of the electronic cigarette are not blocked.

When using the electronic smoking device 10, a consumer may fit the separate replaceable slide-on attachment 500 by sliding the attachment onto the electronic cigarette via the central cavity 106. The dimensions of the central cavity 106 are chosen such to facilitate a press-fit attachment of the slide-on attachment 500 on the electronic cigarette. This press-fit may be further facilitated by choosing to make the material of the inner portion of the cylinder slightly elastic, so it does accommodate any deformation necessary while it slides on the electronic cigarette, and by bouncing back to shape after being slid-on ensures that the attachment remains in place.

The end-cap 300 disposed parallel with the air inhalation port of the electronic cigarette 10 is the upper end-cap. As it may be observed from FIG. 7, the upper end-cap is aligned with the air inhalation port of the electronic cigarette, so that in use, when the user draws via the inhalation port the content vaporized inside the electronic cigarette, it draws as well via the orifices of the end cap the volatile flavor imbibed in the material housed in the lateral cavities 108. The end-cap 300 disposed at the opposite end of the slide-on attachment 500 more towards the end cap of the electronic cigarette is the lower end-cap and facilitates via its orifices the air inlet in the slide-on attachment 500. Once the user draws on the electronic cigarette air ingresses not only into the electronic cigarette but also into the slide-on attachment 500 via the orifices 308 of the lower end-cap. The incoming air facilitates the flow of the volatile flavors stored in the material of cavities 108 towards the mouth of the user.

The consumer may influence the intensity of the flavor by pressing on the slide-on attachment to free more flavored vapors. The intensity of the flavor experienced by the user may also be influenced by the size of the openings 308.

Figure 8:
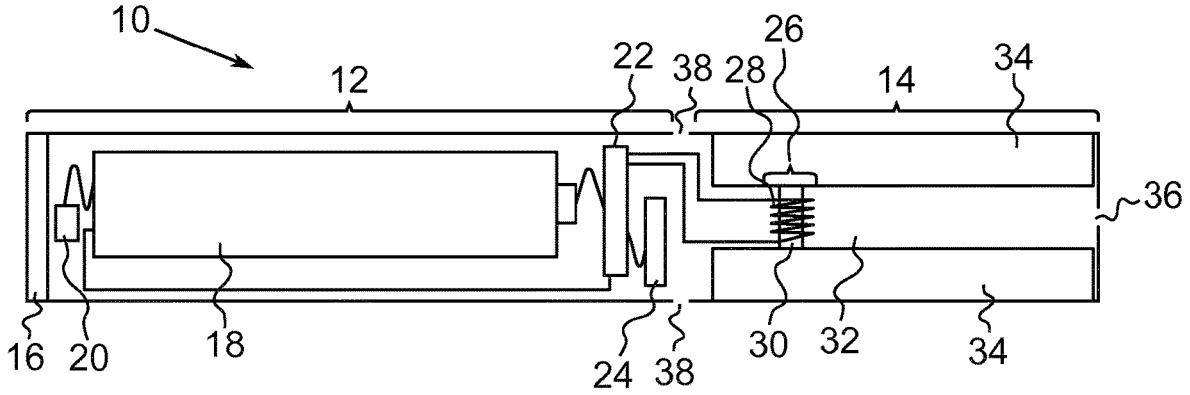
FIG. 8 is a section view of an electronic cigarette as illustrated in FIG. 7.

Throughout this entire document reference has been made to an electronic cigarette or an electronic smoking device. Such an electronic smoking device will be exemplarily described with reference to an e-cigarette. As is shown in FIG. 8, that illustrates in section view an electronic cigarette, an e-cigarette 10 typically has a housing comprising a cylindrical hollow tube having an end-cap 16. The cylindrical hollow tube may be a single-piece or a multiple-piece tube. In FIG. 8, the cylindrical hollow tube is shown as a two-piece structure having a battery portion 12 and an atomizer/liquid reservoir portion 14. Together the battery portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The battery portion 12 and atomizer/liquid reservoir portion 14 are typically made of metal, e.g. steel or aluminum, or of hardwearing plastic and act together with the end-cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end-cap 16 is provided at the front end of the battery portion 12. The end-cap 16 may be made from translucent plastic or other translucent material to allow an LED 20 positioned near the end cap to emit light through the end cap. The end-cap can be made of metal or other materials that do not allow light to pass.

An air inlet may be provided in the end-cap, at the edge of the inlet next to the cylindrical hollow tube, anywhere along the length of the cylindrical hollow tube, or at the connection of the battery portion 12 and the atomizer/liquid reservoir portion 14. FIG. 8 shows a pair of air inlets 38 provided at the intersection between the battery portion 12 and the atomizer/liquid reservoir portion 14.

A battery 18, a light-emitting diode (LED) 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end-cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity. The electronic smoking device 10 comprises only liquid reservoirs 34 comprising unflavored liquid and does not comprise any reservoirs comprising a flavored liquid inside the housing of the electronic smoking device.

An air inhalation port 36 is provided at the back end of the atomizer/liquid reservoir portion 14 remote from the end-cap 16. The inhalation port 36 may be formed from the cylindrical hollow tube atomizer/liquid reservoir portion 14 or maybe formed in an end-cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end-cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarettes are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end-cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 9:
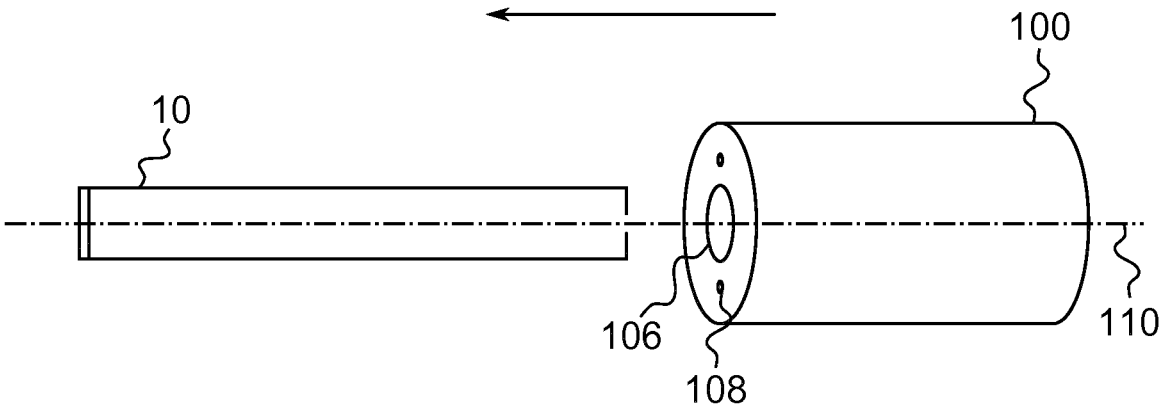
FIG. 9 is a perspective view of a slide-on attachment being installed on an electronic cigarette.

FIG. 9 is a perspective view of a slide-on attachment being installed on an electronic cigarette.

As it may be observed in FIG. 9, the slide-on attachment 500 is installed on the electronic cigarette 10 by moving the slide-on attachment along the axis 110 of the slide-on attachment in a direction indicated by the arrow. A longitudinal axis of the electronic cigarette 10 coincides with a longitudinal axis 110 of the slide-on attachment. The axis 110 passes through the center of a section of the central cavity 106 of the slide-on attachment. The lateral cavities 108 are provided in a symmetric arrangement versus the central axis 110 and in a symmetric arrangement versus each other. A user wishing to install the slide-on attachment 500 on the electronic cigarette 10 aligns the central cavity 106 of the slide-on attachment with the axis of the electronic cigarette 10 and moves the slide-on attachment in the direction of the arrow. The slide-on attachment is aligned with the end of the electronic cigarette so that the air inhalation port 36 of the electronic cigarette remains free and accessible to the user.

In summary, the present invention provides a slide-on attachment for use with an electronic smoking device. The slide-on attachment comprises a body and a plurality of end-caps fitted on the body. The body comprises a plurality of cavities, the plurality of cavities comprising a central cavity capable of facilitating fitting the slide-on attachment on the electronic smoking device, and a plurality of lateral cavities, each lateral cavity comprising a material imbibed with flavored fluid.

The plurality of end-caps fitted on the body comprises an upper end-cap and a lower end-cap disposed at the extremities of the body, the end-caps comprising a plurality of legs with orifices and a central circular opening. The central circular opening of the end-caps overlaps an opening of the central cavity, and a diameter of the central circular opening is equal with a diameter of the central cavity of the body.

The legs of the end-caps with orifices are fitted in openings of the plurality of lateral cavities to facilitate fitting the end-caps on the body.

A cross-section shape of the body and a cross-section shape of the end-caps is either circular, oval, substantially semicircular, and polygonal. The body comprises a shape-memory polymer.

The cavities extend longitudinally for the entire length of the body substantially parallel with a central axis of the body. Alternatively, the lateral cavities extend generally in a longitudinal direction over at least part of the length of the body. The lateral cavities are provided in a symmetric arrangement versus a central axis of the body and in a symmetric arrangement versus each other. A cross-sectional shape of the lateral cavities, along at least part of their length, is one of circular, oval and substantially semicircular.

The material imbibed with flavored fluid is one of a sponge material, wadding or cotton, and the fluid is a hydrophilic liquid. The liquid comprises at least one of the constituents included in the following group: water, polyoles, glycerol, propylene glycol.

The present invention also provides a system, comprising a slide-on attachment as described above fitted on an electronic smoking device. The electronic smoking device comprises a housing with a atomizer/liquid reservoir portion, an electric power source, an electrically heatable atomizer adapted to atomize the liquid supplied from a capsule, an interface adapted to mount the capsule at the electronic smoking device, and control electronics. When the slide-on attachment is fitted on the electronic smoking device, the atomizer/liquid reservoir portion is surrounded by the slide-on attachment and the fitting may be performed via press-fit. When the slide-on attachment is fitted on the electronic smoking device, at least a part of the slide-on attachment is disposed around the atomizer/liquid reservoir portion in a direction along the longitudinal axis of the electronic smoking device. When the slide-on attachment is fitted on the electronic smoking device, an end-cap of the slide-on attachment is aligned with the end of the atomizer/liquid reservoir portion that is facing the user.

An advantage of such a slide-on attachment may be that flavor materials may be provided via cold delivery. They do not need to be atomized or vaporized with the atomized liquid in order to be provided to the user. Atomizing the materials may affect the make-up of the materials and their flavors. For example, the taste of a flavored material may change by atomization or vaporization, in particular due to thermal changes of the material.

Also, since the flavor material is not atomized within the electronic cigarette, less accumulation of gunk will occur on the heating wire and as a result, the life span of the heating coil will be extended.

With the present invention, no thermal changes are applied to the flavor material stored in the lateral cavities, the thermal changes potentially being undesired due to the fact that they affect the quality of the flavor material, its taste intensity and may also lead to the undesired decomposition of the material responsible for the flavor.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that occur to those skilled in the art. Such other examples, which may be available either before or after the application filing date, are intended to be within the scope of the claims if they have elements that do not differ from the literal language of the claims, or if they have equivalent elements with insubstantial differences from the literal language of the claims.

LIST OF REFERENCE SIGNS

10 electronic smoking device
12 battery portion
14 atomizer/liquid reservoir portion
16 end cap
18 battery
20 light-emitting diode (LED)
22 control electronics
24 airflow sensor
26 atomizer
28 heating coil
30 wick
32 central passage
34 liquid reservoir
36 air inhalation port
38 air inlets
100 cylindrical body of a slide-on attachment
102 liner
104 inner portion of the cylindrical body
106 central cavity
108 lateral cavities
110 central axis of cylinder 100
112 upper end of cylinder 100
114 lower end of cylinder 100
300 end-cap
302 body of end-cap
304 (pair of) leg(s) of end-cap
306 circular opening of end-cap
308 lateral opening(s) of the end-cap
500 slide-on attachment for an electronic cigarette

The invention claimed is:

1. A slide-on attachment for use with an electronic smoking device, the slide-on attachment comprising:

a body including a plurality of cavities, wherein the body is configured to slide-on and attach to the electronic smoking device, said plurality of cavities comprising:

a first cavity capable of facilitating fitting the slide-on attachment on the electronic smoking device within the first cavity, wherein the first cavity is formed as a central cavity extending through the body, and at least one second cavity acting as a flavor reservoir and comprising a volatile flavored material, wherein the at least one second cavity is formed as a lateral cavity being spaced apart from the first cavity in a direction extending lateral to a longitudinal axis of the body, and at least one end-cap, either formed as an upper end-cap or formed as a lower end-cap and detachably fitted and disposed at an extremity of said body, wherein said at least one end-cap comprises at least one leg with at least one orifice and a central circular opening.

2. The slide-on attachment of claim 1, wherein said central circular opening of the at least one end-cap overlaps an opening of said central cavity, and a diameter of said central opening is equal with a diameter of said central cavity.

3. The slide-on attachment of claim 1, wherein said at least one leg is fitted in said at least one second cavity to facilitate fitting the at least one end-cap on the body.

4. The slide-on attachment of claim 1, wherein a cross-section shape of said body and a cross-section shape of the at least one end-cap is selected from the following group: circular, oval, substantially semicircular, and polygonal.

5. The slide-on attachment of claim 1, wherein said body comprises a shape-memory polymer.

6. The slide-on attachment of claim 1, wherein said plurality of cavities extend longitudinally for the entire length of the body and in parallel with a central axis of the body.

7. The slide-on attachment of claim 1, comprising a plurality of lateral cavities extending in a longitudinal direction over at least part of the length of the body.

8. The slide-on attachment of claim 7, wherein said at least one second cavity is a plurality of lateral cavities provided in a symmetric arrangement with respect to a central axis of the body and/or in a symmetric arrangement with respect to one another.

9. The slide-on attachment of claim 1, wherein said flavored material comprises a material imbibed with flavored fluid and is one of a sponge material, wadding or cotton, and wherein said fluid is a hydrophilic liquid.

10. A system, comprising:

a slide-on attachment including a body having a plurality of cavities, said plurality of cavities-comprising:

a first cavity capable of facilitating fitting the slide-on attachment on the electronic smoking device, and at least one second cavity acting as a flavor reservoir and comprising a volatile flavored material, wherein the at least one second cavity is formed as a lateral cavity being spaced apart from the first cavity in a direction extending lateral to a longitudinal axis of the body; and at least one end-cap, either formed as an upper end-cap or formed as a lower end-cap and detachably fitted and disposed at an extremity of said body, wherein said at least one end-cap comprises at least one leg with at least one orifice and a central circular opening; and an electronic smoking device, comprising:

a housing with a atomizer/liquid reservoir portion including a liquid reservoir, and an atomizer adapted to atomize a liquid supplied from the liquid reservoir; and a battery portion accommodating an electric power source.

11. The system of claim 10, wherein when the slide-on attachment is fitted on the electronic smoking device, the atomizer/liquid reservoir portion is surrounded by the slide-on attachment, wherein said fitting is performed via press-fit.

12. The system of claim 10, wherein, when the slide-on attachment is fitted on the electronic smoking device, at least a part of the slide-on attachment is disposed around the atomizer/liquid reservoir portion in a direction along a longitudinal axis of the electronic smoking device, and wherein the at least one end-cap of the slide-on attachment is aligned with an end portion of the atomizer/liquid reservoir portion.

13. The system of claim 10, wherein said central circular opening of the at least one end-cap overlaps an opening of said central cavity, and a diameter of said central opening is equal with a diameter of said central cavity.

14. The system of claim 10, wherein the at least one leg is fitted in said at least one second cavity to facilitate fitting the end-cap on the body.

15. The system of claim 10, wherein said plurality of cavities extend longitudinally for the entire length of the body and in parallel with the longitudinal axis of the body.

* * * * *